US006817125B2

(12) United States Patent
Chatterjea

(10) Patent No.: US 6,817,125 B2
(45) Date of Patent: Nov. 16, 2004

(54) PICTURE FRAME ASSEMBLY

(76) Inventor: Probir Chatterjea, 211 Darien La., Sleepy Hollow, IL (US) 60118

( * ) Notice: Subject to any disclaimer, the term of this patent is extended or adjusted under 35 U.S.C. 154(b) by 0 days.

(21) Appl. No.: 10/273,005

(22) Filed: Oct. 17, 2002

(65) Prior Publication Data

US 2004/0074130 A1 Apr. 22, 2004

(51) Int. Cl.[7] ..... G09F 7/02

(52) U.S. Cl. ..... 40/611.02; 40/606.15; 40/661.06; 40/611.03

(58) Field of Search ..... 40/606.11, 606.15–606.16, 40/611.02, 611.03, 611.04, 661.06, 661.07, 606.08

(56) References Cited

U.S. PATENT DOCUMENTS 224,590 A * 2/1880 Grubbs ..... 52/716.1
279,290 A * 6/1883 Von Der Wulbeke ..... 108/48
1,573,264 A * 2/1926 Mankameyer ..... 40/611.03
4,756,108 A * 7/1988 Lackey et al. ..... 40/611.03

* cited by examiner

*Primary Examiner*—Cassandra H. Davis
(74) *Attorney, Agent, or Firm*—King & Jovanovic, PLC

(57) ABSTRACT

A picture frame assembly comprising a body, a picture retaining assembly and a mounting assembly. The picture retaining assembly is associated with the body, and facilitates the display of a picture within the body. The mounting assembly comprises a wall engaging assembly attachable to a wall and a pivoting engagement assembly. The pivoting engagement assembly is hingedly associated with each of the wall engaging assembly and the body, to, in turn, rotate the body between a display position to a set-up position.

14 Claims, 6 Drawing Sheets

PICTURE FRAME ASSEMBLY

BACKGROUND OF THE INVENTION

1. Field of the Invention

The present invention relates in general to a picture frame assembly, and more particularly, to a picture frame assembly which facilitates attachment thereof to a wall or other support structure, while facilitating replacement of the pictures mounted therein without full removal of the picture frame from the wall or support structure.

2. Background Art

Picture frames have long been used to display photographs, paintings and the like. They provide a decorative finish to the underlying item and provide protection as well. Various picture frames have been developed for use, including picture frames which facilitate attachment to a wall, which facilitate enhanced picture placement and removal within the frame, and which facilitate storage of additional pictures therein for convenience.

However, there has been a deficiency in the art with respect to picture frames for displaying single pictures or panoramic composites of a plurality of pictures which can be mounted to a wall, yet, can easily be configured with replacement pictures. In particular, picture frames generally require removal from the wall prior to replacement of the picture. This is especially problematic with highly ornate and heavy picture frames, as such frames are difficult to handle.

Accordingly, it is an object of the invention to overcome the deficiencies in the prior art. This object as well as other objects of the present invention will become apparent in light of the present specification, claims, and drawings.

SUMMARY OF THE INVENTION

The invention comprises a picture frame assembly which includes a body, a picture retaining assembly and a mounting assembly. The picture retaining assembly is associated with the body, to, in turn, facilitate the display of a picture within the body. The mounting assembly comprises a wall engaging assembly attachable to a wall and a pivoting engagement assembly. The pivoting engagement assembly is hingedly associated with each of the wall engaging assembly and the body. In turn, the pivoting engagement assembly is capable of facilitating rotation of the body between a display position to a set-up position. In a preferred embodiment, the body further comprises an outer frame and an inner frame.

In another preferred embodiment, the picture retaining assembly further comprises a plurality of anchor blocks, a plurality of clamp bars and a fastening assembly associated with the anchor blocks and capable of selective coupling with a portion of at least one of the plurality of clamp bars to substantially retain a picture between the clamp bar and the body.

In one such preferred embodiment, the picture retaining assembly further comprises a transparent substrate. The transparent substrate is positioned within the body such that the fastening assembly associated with the anchor blocks and fastens a picture between the clamp bar and the transparent substrate.

In another preferred embodiment, the pivoting engagement assembly further comprises a wall engagement assembly interface and a frame engagement assembly. The wall engagement assembly interface includes at least one support rod positionable within a channel of the wall engaging assembly. The frame engagement assembly including a hinge member attached to the at least one support rod and to the body, to in turn, facilitate hinged movement therebetween.

In one preferred embodiment, the channel of the wall engaging assembly comprises a support rod guide associated with the wall engaging assembly.

In another such embodiment, the at least one support rod is associated with a base, the hinge member associated with the base at the one end and to the body at the other end, to facilitate hinged movement of the hinge member relative to the body.

In yet another preferred embodiment, the body further comprises at least one decorative member attached thereto. Preferably, the decorative member comprises at least one side post attached to a side of the body.

In another preferred embodiment, the assembly further comprises at least one divider associated with the body, to, in turn, divide a display area into a plurality of areas. In one such embodiment, the invention further comprises at least one middle panel associated with the at least one divider, to, in turn, provide a decorative member to the at least one divider.

Preferably, the invention further includes a control assembly for controlling the movement of the body relative to the wall engaging assembly. In one embodiment, the control assembly further comprises a locking member. The locking member preferably further comprises at least one rest bar associated with the wall engaging assembly and a stop tab associated with the body.

In another embodiment, the control assembly further comprises a movement limiting member. Preferably, the movement limiting member comprises a support string.

BRIEF DESCRIPTION OF THE DRAWINGS

The invention will now be described with reference to the drawings wherein.

DETAILED DESCRIPTION OF THE INVENTION

Figure 1:
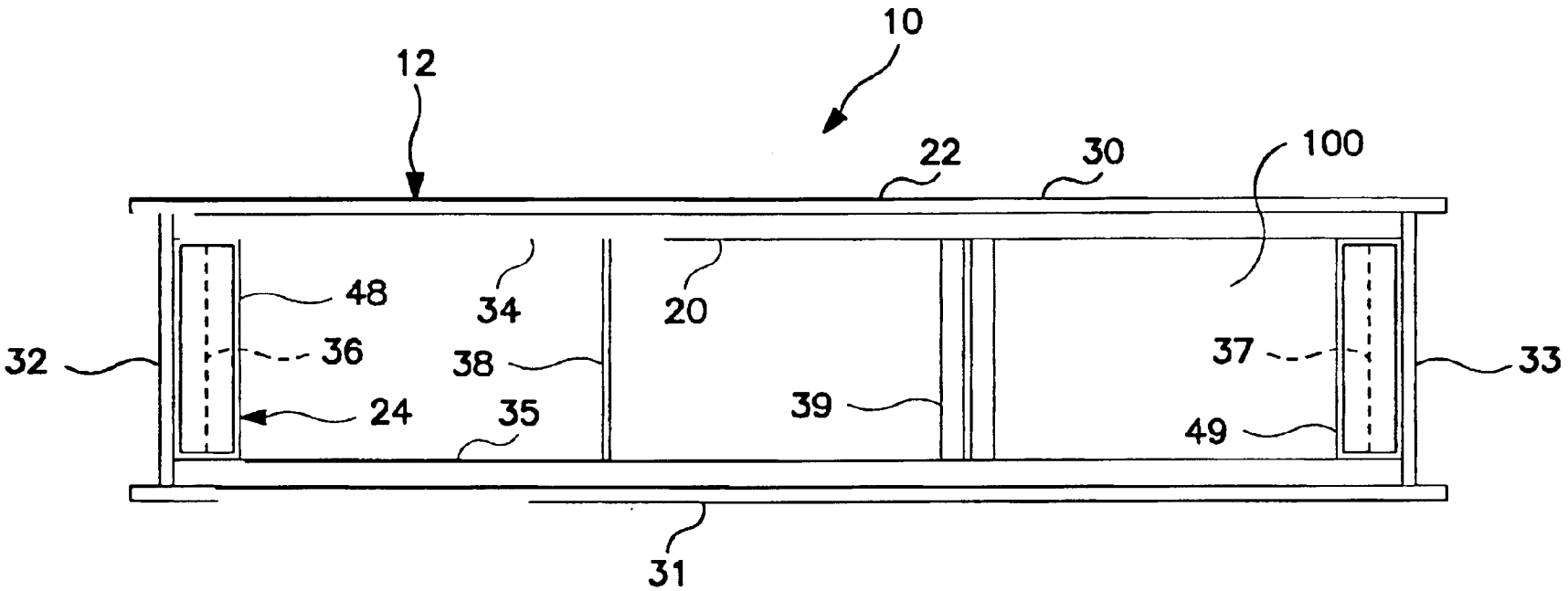
FIG. 1 of the drawings is a front plan view of the picture frame assembly of the present invention.

While this invention is susceptible of embodiment in many different forms, there is shown in the drawings and described herein in detail several specific embodiments with the understanding that the present disclosure is to be considered as an exemplification of the principles of the invention and is not intended to limit the invention to the embodiments illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIG. 1, picture frame assembly 10 includes body 12, picture retaining assembly 14 (FIG. 2), and mounting assembly 16. It will be understood that picture frame assembly 10 is provided to display pictures, such as picture 100. Such pictures are not limited to any particular type of medium, and may comprise drawings, photographs, paintings and the like, which may include both two dimensional and three dimensional material.

Body 12 is shown in FIG. I as comprising inner frame 20, outer frame 22 and decorative member 24. Inner frame 20 includes top bar 30, bottom bar 31 and side bars 32, 33. Outer frame 22 is shown as comprising top web 34, bottom web 35 and side webs 36, 37. The various components may be attached to each other by way of adhesive, fasteners (i.e., nails, screws, etc.), brackets, press fits, slots and tabs, among others. It is contemplated that these individual components may comprise a wood based material. Of course, other materials such as composites, metals and plastics are likewise contemplated, as are bodies composed of various combinations of the foregoing.

In addition, it is contemplated that instead of a plurality of separate components, certain of the components may be molded into a single integrated member. For example, top bar 30 and top web 34 may comprise a single molded member. Similarly, the side webs and the side panels may comprise a single material. Further still, the outer frame and the inner frame may each comprise a single member.

Moreover, while the invention is shown wherein body 12 comprises a substantially rectangular configuration, a plurality of different configurations are likewise contemplated for use. Such different configurations may comprise squares, circles, triangles, parallelograms, etc.

Decorative member 24 is shown in FIG. 1 as comprising side panels 48, 49 which are attachable to respective side webs 36, 37. The side panels may have a decorative surface finish which provides an aesthetically pleasing finish to the picture frame. Moreover, the side panels can be provided in a number of widths (or with adjustable widths) to compensate for varying sizes of pictures positioned therein.

In the embodiment shown in FIG. 1, inner frame 20 may further include dividers, such as divider 38. Such dividers can be utilized wherein the picture frame assembly is suited for the receipt of a number of pictures positioned side by side. In one embodiment, the separate pictures may comprise a panoramic composite picture. In other embodiments, the pictures may be related but separate entities. In any such embodiment, decorative member 24 further comprises middle panel 39 which is positioned above divider 38. Like the side panels, the middle panel may comprise a variety of different designs to complement the picture frame. In addition, the middle panel may comprise a variety of different widths so that it is adaptable to a variety of different sized pictures.

Figure 2:
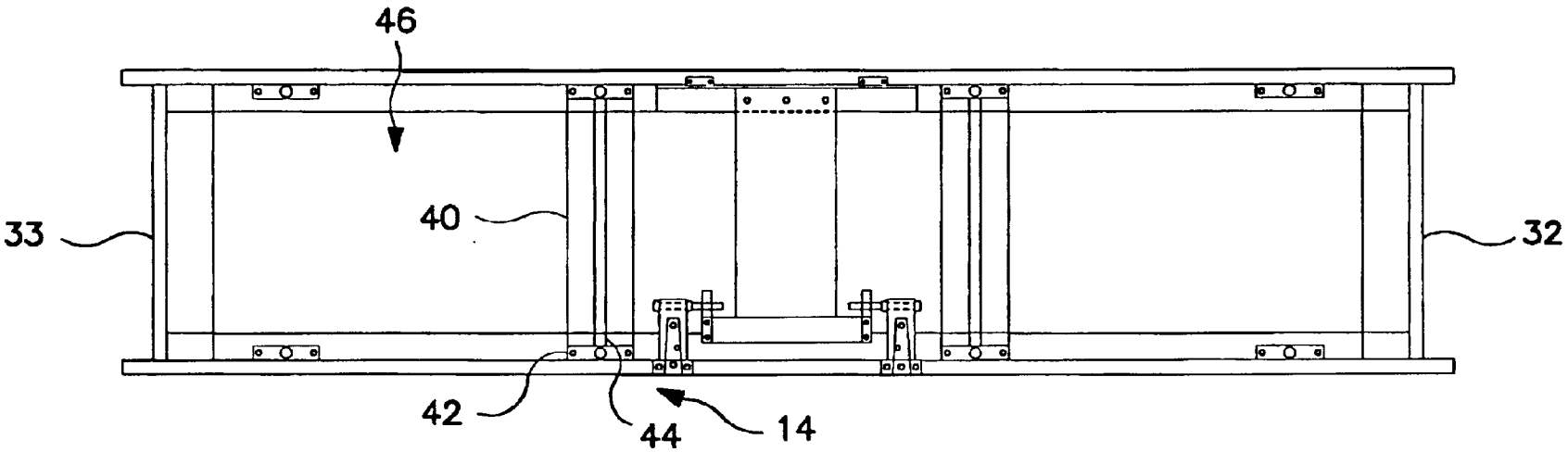
FIG. 2 of the drawings is a back plan view of the picture frame assembly of the present invention.

Picture retaining assembly 14 is shown in FIG. 2 as comprising clamp bars, such as clamp bar 40, anchor blocks, such as anchor blocks 42, fastening assemblies 44 and transparent substrate 46. Anchor blocks 42 are positioned along body 12 from side bar 32 to side bar 33 in a spaced apart orientation on each of the top and bottom sides of the respective outer and inner frames. In the embodiment shown, two upper and two lower anchor blocks are spaced apart from each other. The top anchor blocks are attached to one of the top bar and the top web. The bottom anchor blocks are attached to one of the bottom bar and the bottom web.

Clamp bars, such as clamp bars 40 comprise an elongated bar which is capable of spanning across body 12 from one of the top anchor blocks to a corresponding bottom anchor block. In the embodiment shown, the clamp bars are substantially elongated linear members having a substantially uniform width. In other embodiments, it is contemplated that the clamp bars may comprise a plurality of differently shaped members having a number of different configurations, such as, for example, an "x" configuration which may interact with four anchors. Of course, various different configurations are contemplated for use.

Figure 4:
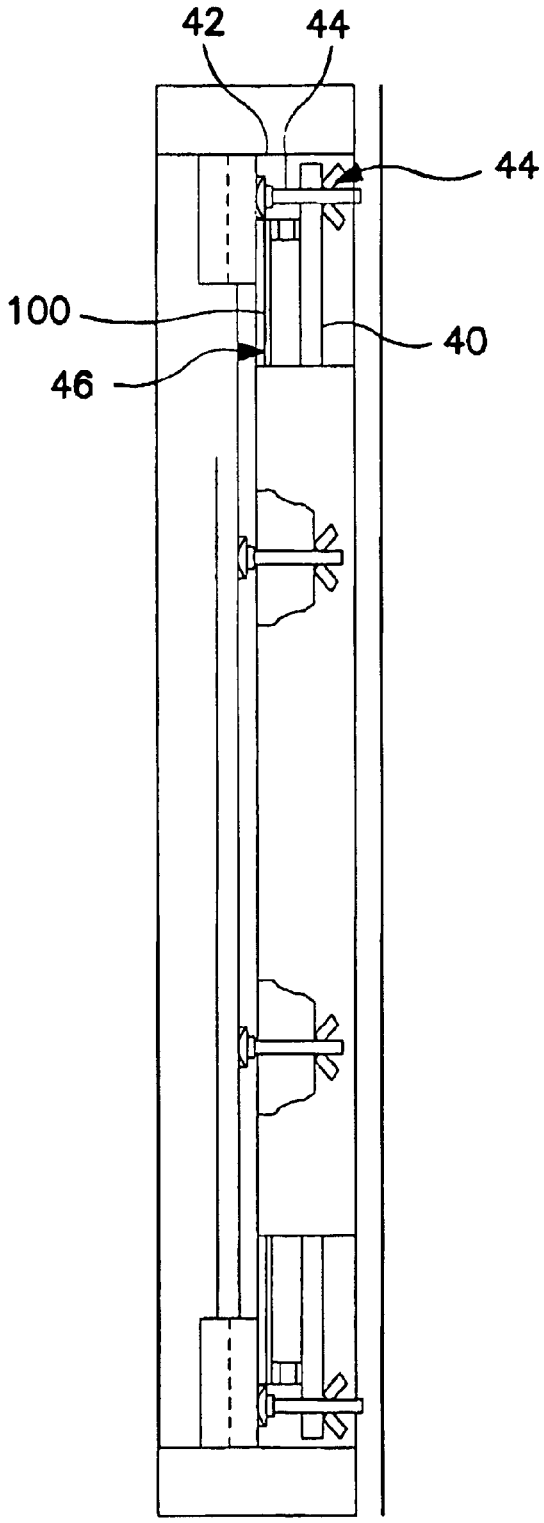
FIG. 4 of the drawings is a cross-sectional view of the body of the picture frame assembly of the present invention.

Referring now to FIG. 4, fastening assemblies, such as fastening assembly 44, comprises a carriage bolt and corresponding wing nut. Each bolt is configured to extend through corresponding bores in the anchor block and the clamp bar. As will be explained, the fastening assembly is capable of compressing the clamp bar toward each of the top and bottom web, and retaining picture 100 therebetween.

Transparent substrate 46 is positioned in front of the picture to protect same from inadvertent destruction of the picture. The transparent substrate may comprise any number of different materials, including, but not limited to glass, plexiglass and other substrates which provide the necessary and desired effect. Of course, with certain embodiments, it is contemplated that the transparent substrate may be omitted.

Figure 3:
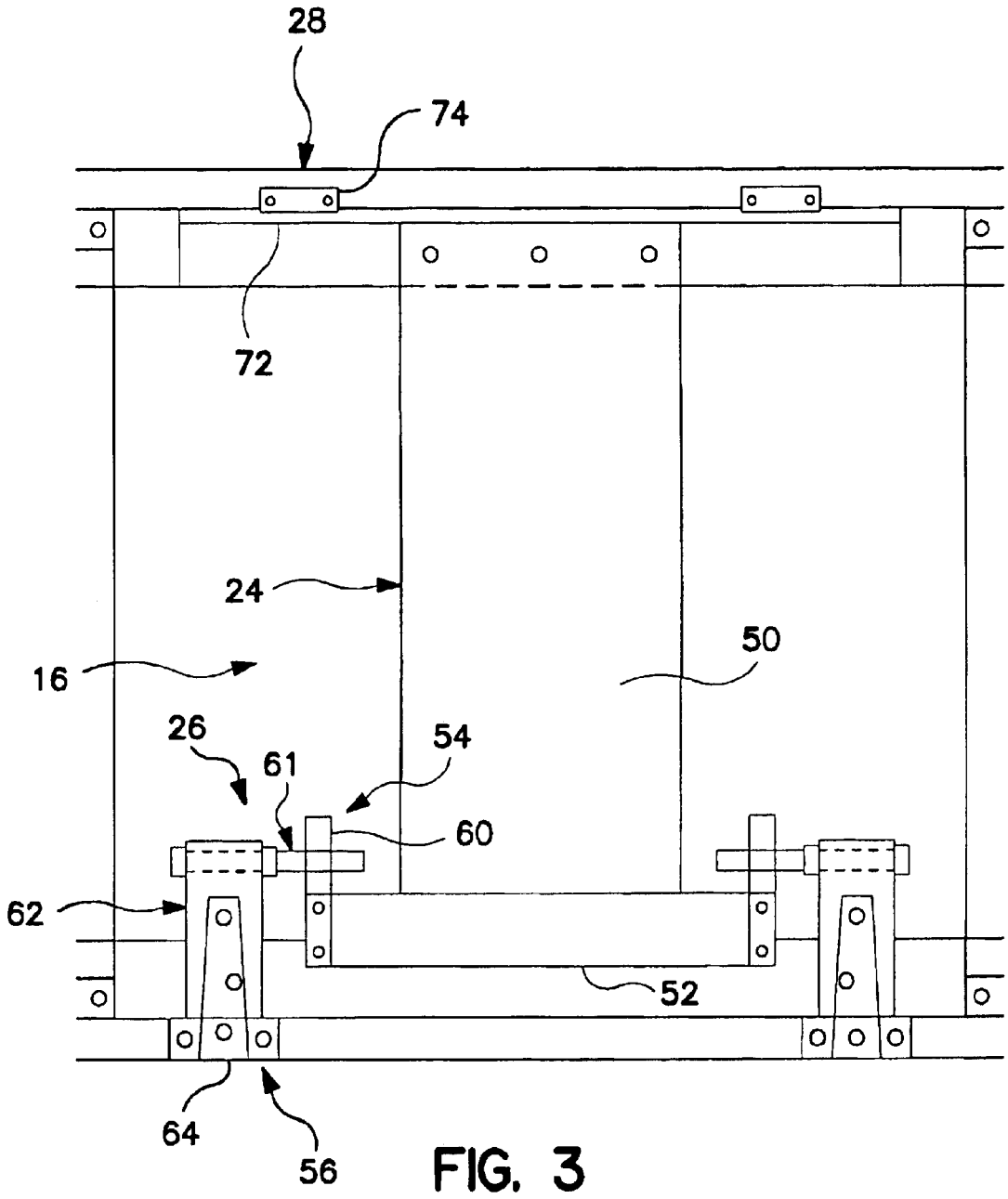
FIG. 3 of the drawings is a partial back plan view of the picture frame assembly of the present invention.

Mounting assembly 16 is shown in FIG. 3 as comprising wall engaging assembly 24, pivoting engagement assembly 26 and control assembly 28. Wall engaging assembly 24 includes wall post 50 and wall bar 52. The wall post and the wall bar are mounted to each other in a fixed engagement. The wall post and wall bar are of suitable strength so as to provide a strong interface with the body and with the wall. In the embodiment shown, wall bar 52 is positioned at approximately the bottom of wall post 50. Of course, a number of different configurations are contemplated for the wall engaging assembly, as long as such structures are capable of providing the necessary attributes.

Pivoting engagement assembly 26 is shown in FIG. 3 as comprising wall engagement assembly interface 54 and frame engagement assembly 56. Wall engagement assembly interface 54 includes support rod guide 60, support rod 61 and base 62. While the embodiment shown in FIG. 3 includes two wall engagement assembly interfaces, it is likewise contemplated that a greater or fewer number of such interfaces may be utilized depending on the particular environment and embodiment of use. It will be understood that one of the wall engagement assembly interfaces will be explained in detail with the understanding that the other wall engagement assembly interface of the present embodiment is substantially identical.

Support rod guide 60 comprises a member which is attached to the wall bar such that a portion of the support rod guide in cooperation with the wall or underlying substrate defines channel 70 for receipt of the support rod. Support rod guide 60 may comprise a variety of different materials, including but not limited to metals, plastics, composites, etc. In addition, it is contemplated that the support rod guide may be associated with other components of the wall engaging assembly to define a number of different configurations for receipt of the support rod.

Figure 5:
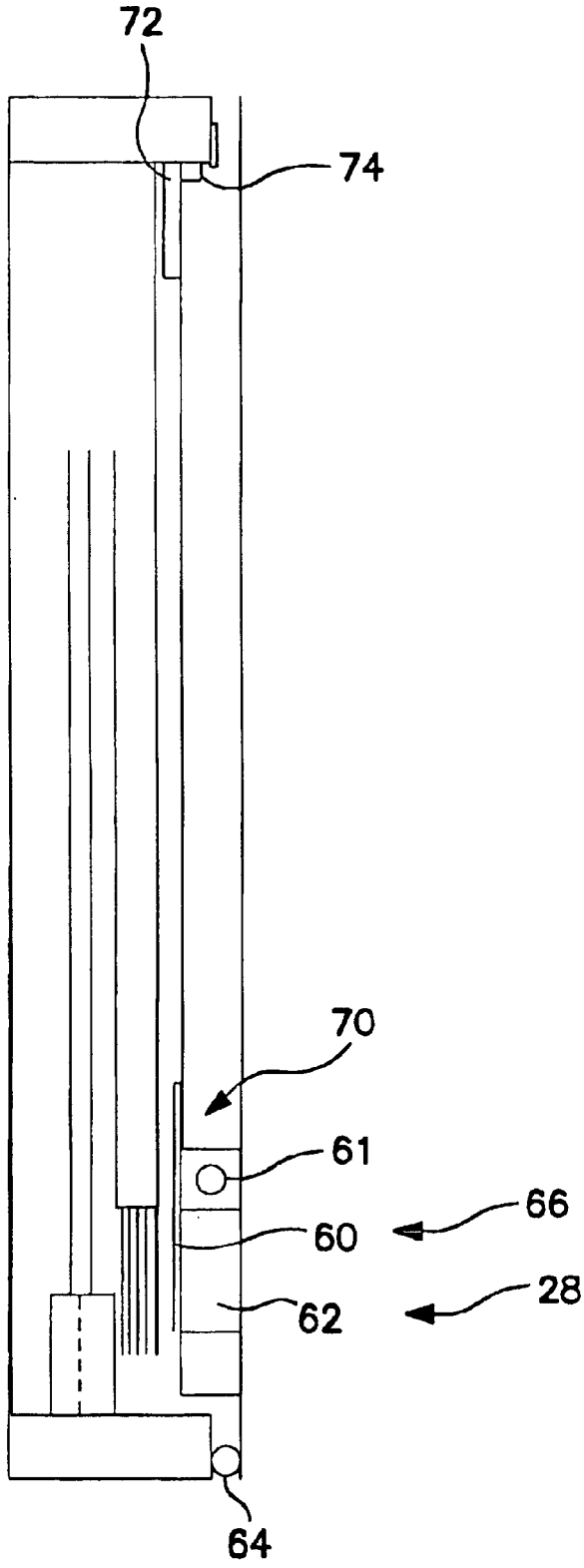
FIG. 5 of the drawings is a partial cross-sectional view of the picture frame assembly of the present invention.

Support rod 61 is shown in FIGS. 3 and 5 as extending from base 62. The support rod and the base are configured such that the support rod can be extended into channel 70 defined by support rod guide 60 and the underlying wall. In such an embodiment, frame engagement assembly 56 comprises hinge member 64. Hinge 64 is attached at the one end to base 61 and to body 12 at the other end. As such hinge 64 facilitates the hinged pivoting movement of base 61, and in turn, rod guide 60 relative to body 12.

Figure 7B:
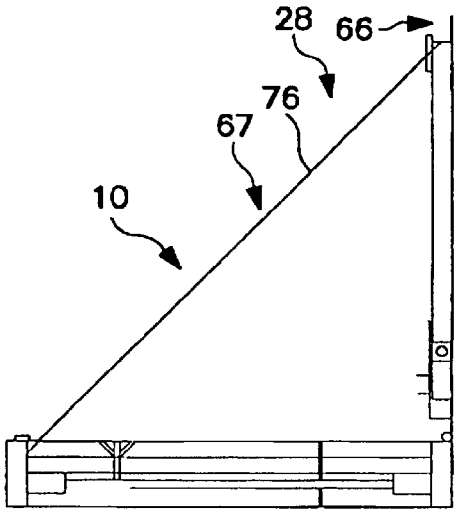
FIGS. 7*a*–7*b* of the drawings comprise a partial side elevational view of the picture frame assembly of the present invention, showing, in particular, the operation of the movement limiting member.
Figure 7A:
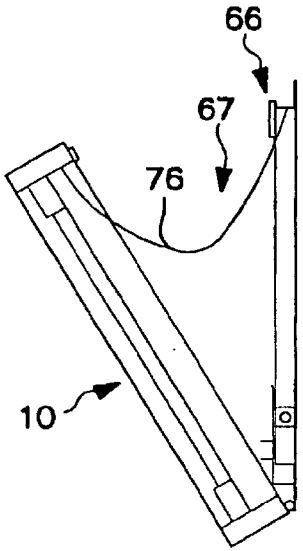

Control assembly 28, as is shown in FIGS. 7A and 7B, comprises locking member 66 and movement limiting member 67. Locking member 66 comprises rest bar 72 and stop tab 74. Rest bar 72 is associated with wall engaging assembly 24, and in particular, with wall post 50. Stop tab 74 is associated with body 12, and in particular, with top bar 30 of outer frame 22. The rest bar and the stop tab cooperate to lock body 12 relative to wall engaging assembly 24, and to preclude the rotation about hinge member 64. Of course, a number of different assemblies which preclude the rotative movement of hinge member are contemplated for use.

As is shown in FIGS. 7A and 7B, movement limiting member 67 comprises support string 76. Support string 76 is attached at the one end to wall engaging assembly 24, and at the other end to body 12. The support string is configured such that in a taut position, the rotation of the body relative to the wall engaging assembly about hinge 54 can be limited to, in the present embodiment substantially ninety degrees, or the body is limited to movement from a vertical position to a horizontal position. Of course, any number of members for limiting the rotation of the hinge are contemplated for use, including, brackets, braces, limiters, etc.

In operation, the user first mounts wall engaging assembly 24 in a desired location on a wall or other substrate. The wall engaging assembly is then secured thereto with a plurality of fasteners extending through at least one of wall post 50 and wall bar 52. Subsequently, support rods 61 are inserted into respective channels 70. At such time, body 12 is capable of hingedly rotating relative to wall engaging assembly 24 and, in turn, the underlying wall. Next, support string 76 is attached at the one end to the body and at the other end to the wall engaging assembly. While other configurations are contemplated, in the embodiment shown, the support string is permanently fixed to the frame, and attachable to a hook on the wall engaging assembly. As is shown in FIGS. 7A and 7B, the rotation can be controlled and stopped in a position wherein the body is rotated away from the wall.

In such a rotated, set-up, configuration, the user can position the desired pictures within the frame. Once the desired pictures are positioned, the user attaches the respective clamp bars to the respective anchor blocks and secures same with the respective fastening assemblies. In certain embodiments, the frame is dimensionally capable of retaining a number of pictures behind the displayed picture which is retained in position by the clamp bars. In such embodiments, such a frame has additional utility as a storage unit for additional pictures.

Figure 6B:
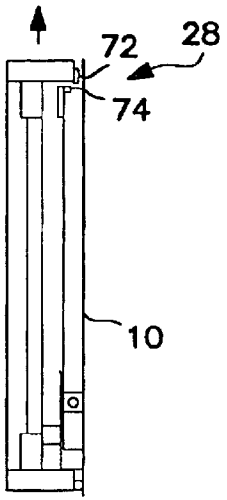
FIGS. 6*a*–6*b* of the drawings comprise a sequential schematic representation of the actuation of the locking member of the picture frame assembly of the present invention.
Figure 6A:
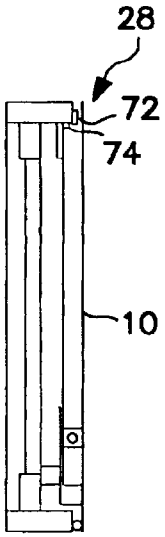

With reference to FIGS. 6A and 6B, once the mounting of the pictures is complete, the user can rotate the frame about hinge 64 until the frame abuts the wall or the wall engaging assembly. At such time, the user merely lifts the frame slightly relative to the wall engaging assembly such that stop tab 74 clears rest bar 72. Once cleared, the frame can be lowered such that the frame rests upon the rest bar and the stop tab preclude rotative movement of the frame beyond the rest bar. In such a picture displaying position, the weight of the frame is substantially carried by the rest bar and, in turn the wall post 50. In such a position, the support rods are substantially suspended within respective channels 60 and are substantially not weight bearing. Additionally, the user can slightly adjust the frame relative to the rest bar to fine tune the position of the frame relative to the wall. For example, if the frame appears tilted, additional shims may be placed proximate a portion of the rest bar to elevate one side of the frame, to, in turn, fine tune and level the frame. Such shims may be retained in position with Velcro members or the like.

Prior to rotation or after rotation, the user can attach any number of decorative members about the frame. For example the user can select from a number of different decorative side panels. In embodiments having dividers, the user can additionally mount any number of different middle panels. These panels are attached to the underlying side webs 36, 37 or dividers 38 by way of screws and the like.

As desired, the user can again disengage the stop tab and the rest bar to rotate the frame member to a substantially horizontal position. In such a position, the user can again manipulate the different pictures as desired.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A picture frame assembly comprising:

a body;

a picture retaining assembly associated with the body, to, in turn, facilitate the display of a picture within the body, the picture retaining assembly further comprising:

a plurality of anchor blocks;

a plurality of clamp bars; and a fastening assembly associated with the anchor blocks and capable of selective coupling with a portion of at least one of the plurality of clamp bars to substantially retain a picture between the clamp bar and the body; and a mounting assembly, the mounting assembly comprising:

a wall engaging assembly attachable to a wall; and a pivoting engagement assembly, wherein the pivoting engagement assembly is hingedly associated with each of the wall engaging assembly and the body, to, in turn, rotate the body between a display position to a set-up position.

2. The picture frame assembly of claim 1 wherein the body further comprises:

an outer frame; and an inner frame.

3. The picture frame assembly of claim 1 wherein the picture retaining assembly further comprises a transparent substrate, the transparent substrate positioned within the body such that the fastening assembly associated with the anchor blocks and fastens a picture between the clamp bar and the transparent substrate.

4. The picture frame assembly of claim 1 wherein the body further comprises at least one decorative member attached thereto.

5. The picture frame assembly of claim 4 wherein the decorative member comprises at least one side post attached to a side of the body.

6. The picture frame assembly of claim 1 further comprising at least one divider associated with the body, to, in turn, divide a display area into a plurality of areas.

7. The picture frame assembly of claim 6 further comprising at least one middle panel associated with the at least one divider, to, in turn, provide a decorative member to the at least one divider.

8. The picture frame assembly of claim 1 further comprising a control assembly for controlling the movement of the body relative to the wall engaging assembly.

9. The picture frame assembly of claim 8 wherein the control assembly further comprises a locking member.

10. The picture frame assembly of claim 9 wherein the locking member further comprises:

at least one rest bar associated with the wall engaging assembly; and a stop tab associated with the body.

11. The picture frame assembly of claim 8 wherein the control assembly further comprises a movement limiting member.

12. The picture frame assembly of claim 11 wherein the movement limiting member comprises a support string.

13. A picture frame assembly comprising:

a body;

a picture retaining assembly associated with the body, to, in turn, facilitate the display of a picture within the body; and a mounting assembly, the mounting assembly comprising:

a wall engaging assembly attachable to a wall; and a pivoting engagement assembly, wherein the pivoting engagement assembly is hingedly associated with each of the wall engaging assembly and the body, to, in turn, rotate the body between a display position to a set-up position, the pivoting engagement assembly further comprises:

a wall engagement assembly interface including at least one support rod positionable within a channel of the wall engaging assembly; and a frame engagement assembly including a hinge member attached to the at least one support rod and to the body, to in turn, facilitate hinged movement therebetween, wherein the at least one support rod is associated with a base, the hinge member associated with the base at the one end and to the body at the other end, to facilitate hinged movement of the hinge member relative to the body.

14. The picture frame assembly of claim 13 wherein the channel of the wall engaging assembly comprises a support rod guide associated with the wall engaging assembly.

* * * * *